US005546643A

United States Patent [19]

Hawes et al.

[11] Patent Number: 5,546,643

[45] Date of Patent: Aug. 20, 1996

[54] METHOD TO REDUCE FORMING FABRIC EDGE CURL

[75] Inventors: John M. Hawes; Joe W. Sims, both of Appleton; Don Lee, Menasha, all of Wis.

[73] Assignee: Albany International Corp., Albany, N.Y.

[21] Appl. No.: 524,234

[22] Filed: Sep. 6, 1995

[51] Int. Cl.[6] ..... D06C 13/00

[52] U.S. Cl. ..... 26/11; 26/DIG. 1; 28/170

[58] Field of Search ..... 26/7, 11, 98, DIG. 1, 26/1, 69 B, 69 C; 139/383 R, 383 A, 402, 404, 408, 420 B; 28/165, 170, 171

[56] References Cited

U.S. PATENT DOCUMENTS

| | | | |
|---|---|---|---|
| 2,117,954 | 5/1938 | Greenwood | 26/11 |
| 3,324,525 | 6/1967 | Knapp et al. | 26/DIG. 1 |
| 3,867,744 | 2/1975 | Tsvchida | 26/DIG. 1 |
| 3,874,043 | 4/1975 | Holm | 26/DIG. 1 |
| 4,941,239 | 7/1990 | Fliss | 27/28 |

*Primary Examiner*—Amy B. Vanatta

*Attorney, Agent, or Firm*—Kane, Dalsimer, Sullivan, Kurucz, Levy, Eisele & Richard

[57] ABSTRACT

A method for reducing or eliminating forming fabric edge curl includes slitting or scoring the knuckles formed by cross-machine direction yarns on the long-shute knuckle side of a papermaker's forming fabric. The knuckles are scored or slit to a depth no greater than half the diameter of the cross-machine direction yarns. At least one such slit or score is provided per knuckle. The scoring or slitting has the effect of bringing the ratio between the shrink forces acting on the two sides of the forming fabric in the cross-machine direction closer to unity, and, in turn, reduces or eliminates the edge curl resulting from shrinkage in the cross-machine direction.

6 Claims, 3 Drawing Sheets

FIG. 4
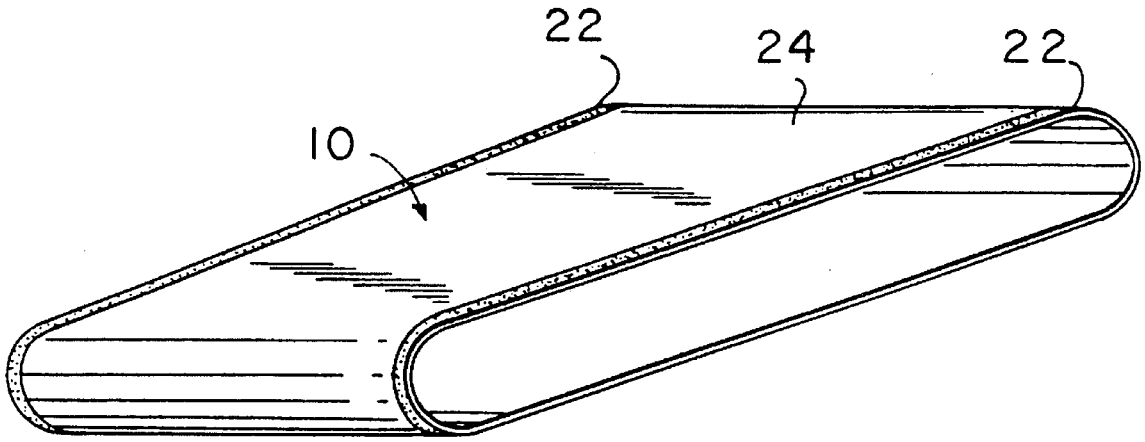
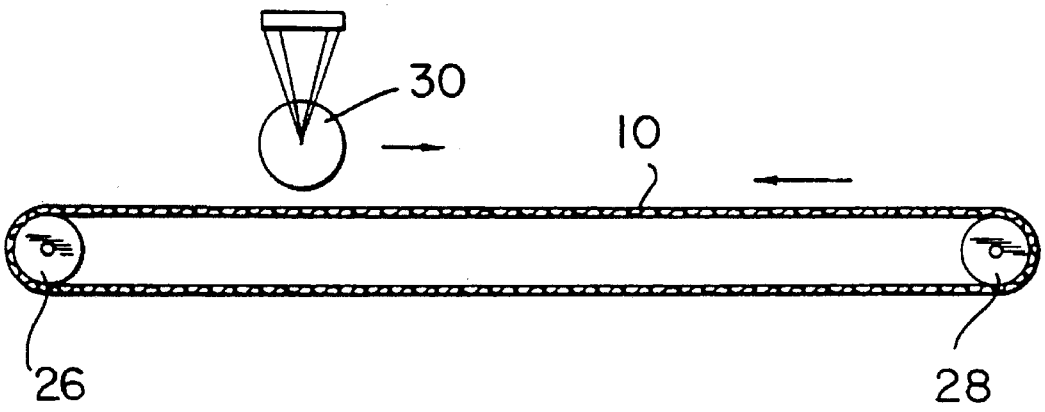
FIG. 5

METHOD TO REDUCE FORMING FABRIC EDGE CURL

BACKGROUND OF THE INVENTION

1. Field of the Invention

The present invention relates to the fabrics used as forming media in modern papermaking machines. More particularly, a method for treating a forming fabric in order to reduce or eliminate the problem of edge curl is disclosed.

2. Description of the Prior Art

Broadly stated, the purpose of modern papermaking machines is to remove water from a stock or furnish consisting of an aqueous suspension of wood fibers and a variety of other ingredients. Generally, modern papermachines are made up of three distinct sections.

The first is the forming section, where the furnish is applied to a moving screen, traditionally referred to in the industry as a wire. The wire's screen-like construction enables water to drain readily from the furnish leaving a web of wet wood fiber on its upper surface.

At the end of the forming section, enough water has drained from the wet wood fiber for it to assume the form of a wet sheet of sufficient structural integrity to be transferred to a press fabric. The wet sheet is carried on to the press section either atop this single press fabric or sandwiched between two such fabrics. The press fabrics serve the purpose of removing further amounts of water from the wet sheet. Here, however, because the water that remains will not drain from the sheet on its own accord, the combination of fabric and wet sheet are passed together through a series of presses where water is squeezed from the sheet and accepted by the fabrics.

At the end of the press section, the wet sheet proceeds to the final stage of the papermachine, the dryer section. There, the sheet is conducted or passed around each in a series of cylinders steam-heated from within. Whatever water still remains in the sheet on reaching the dryer section is gradually driven off by evaporation upon contact with the hot cylinders. Fabrics are employed in this section as well. Here, however, they do not so much carry or conduct the sheet as serve to hold the sheet in intimate contact with the surface of each cylinder as an aid to efficient drying.

The fabrics used in each section take the form of long, continuous, endless moving belts. They are either woven in endless form or seamed into that form. Depending on the papermachine, the belts can be from 1 to 10 meters wide and of considerably longer total length.

As stated rather implicitly above, the paper manufacturing operation is continuous. In other words, furnish is continuously applied to the wire, forming a wet sheet which is transferred, in turn, to the press and dryer section, emerging finally as some form of paper product.

The fabrics used in the forming stage will be our chief concern here. The forming fabrics, or wires, play a crucial role in the papermaking process. They must be highly permeable and allow large quantities of water to drain quickly from the furnish, and must be of a weave to assure optimum sheet formation. Of equal importance, the upper surface of the forming fabric, to which the furnish is applied, should be as smooth as possible in order to assure the formation of a smooth, unmarked sheet.

Formerly, the fabrics used in the forming section were woven from metal threads. For this reason, they are still commonly referred to in the papermaking industry as wires, even though most are now woven from synthetic monofilament.

A wide variety of these fabrics are in current use, and can be characterized by weave pattern and number of layers. One chooses a particular fabric to meet the requirements of the machine on which it is to be installed and the kind of paper to be produced.

Generally, the systems of yarns in a woven fabric lie in directions which can be identified with reference to the directions they take when the fabric is in its position of use on the papermachine. The machine direction yarns lie in the direction in which the fabric as a whole moves when the machine is operating and, accordingly, must bear forces of tension associated with this motion.

Transverse to the machine direction yarns are cross-machine direction yarns. By contrast, the cross-machine direction yarns are subjected to very little, if any, tension on the papermachine.

In some of the weave patterns in current use, the cross-machine direction yarns pass over more than one machine direction yarn before weaving under one such yarn and repeating the pattern. A fabric is thereby produced having an upper surface formed primarily from the cross-machine yarns or shutes. Normally, this side is used for the formation of the paper sheet, and can be referred to as the long-shute knuckle side.

An undesired consequence of such weave patterns is that the forming fabrics so characterized tend to curl in a direction toward the long-shute knuckle side with time as back side wear and/or shrinkage occurs. The curl arises because these cross-machine weave patterns result in the shrink forces on each side of the upper surface being unequal. The resulting curl can cause operational problems on the papermachine.

One prior-art method for reducing forming fabric edge curl is disclosed in U.S. Pat. No. 4,941,239 to Fliss, which patent is commonly assigned with the present invention. The method requires the removal of mass from the sheet-forming side of the forming fabric. This has the effect of reducing the ratio between the shrink forces acting on the two sides of the forming fabric in the cross-machine direction and, in turn, reduces the tendency for shrinkage to cause the edges of the fabric to curl. More specifically, the mass is removed by using a fine abrasive medium on the surface of the fabric. While one could remove mass from the entire sheet-forming side of the forming fabric in this manner, it is preferable to so treat only regions lying in a band along each of the two lateral edges thereof, so as not to adversely affect its paper-forming characteristics.

The present invention provides another solution to the problem of forming fabric edge curl.

SUMMARY OF THE INVENTION

The present invention is a method for reducing forming fabric edge curl which does not require the removal of mass from the cross-machine direction yarns on the long-shute knuckle side. Instead, the imbalance between the shrinking forces on the two sides of the forming fabric is reduced in the practice of the present invention by slitting or scoring the cross-machine direction yarns on the long-shute knuckle side. As with the method shown in U.S. Pat. No. 4,941,239, the slitting or scoring has the effect of reducing the ratio between the shrink forces acting on the two sides of the forming fabric in the cross-machine direction, bringing that ratio downscloser to unity, and, as a consequence, reducing the tendency for shrinkage in the cross-machine direction yarns to cause the edges of the fabric to curl.

In practice, the cross-machine direction yarns on the entire long-shute knuckle side of the forming fabric could be slit or scored. However, optionally, only regions lying in a band along each of the two lateral edges of the forming fabric and not extending into the central region thereof could be so treated, as was the case in U.S. Pat. No. 4,941,239.

In general, the number of slits or scores per knuckle of the cross-machine direction yarns could be varied, but at least one slit or score per knuckle is desired. The depth of the slit or score is preferably no greater than one-half of the diameter of the cross-machine direction yarn.

While the present invention is described in detail below as applied to a single-layered forming fabric of a specific weave, it should be clearly understood that it can be generally applied to reduce edge curl in all kinds of forming fabrics, both single- and multi-layered.

BRIEF DESCRIPTION OF THE DRAWINGS

FIG. 4 is a perspective view of a forming fabric showing the bands lying along its lateral edges which may, as an option, be the only regions of the surface of the forming fabric treated in accordance with the method disclosed here to reduce edge curl; and FIG. 5 is a side view of a forming fabric mounted and under tension on a finishing table. Its surface is being treated with a cutting tool to provide the slits or scores for reducing edge curl.

DETAILED DESCRIPTION OF THE PREFERRED EMBODIMENT

Figure 1:
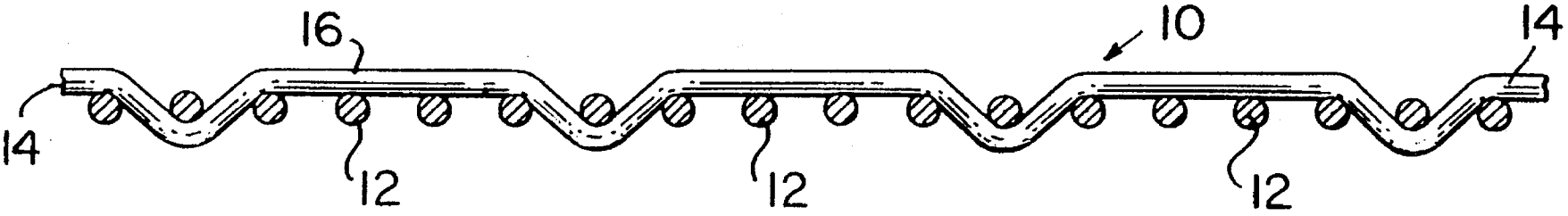
FIG. 1 is a cross-sectional view, taken in the machine direction, of a single-layer forming fabric, wherein the cross-machine direction yarns are woven in an "under one and over four" (1×4) pattern.
Figure 2:
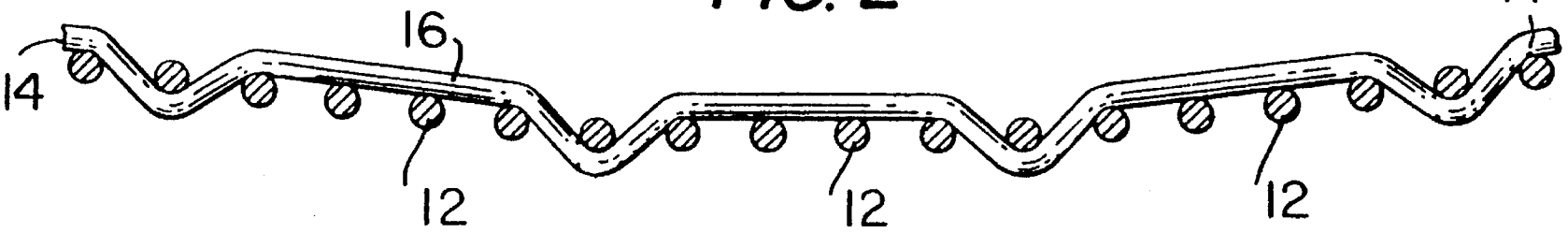
FIG. 2 is a cross-sectional view similar to that shown in FIG. 1 but taken after shrinkage in the cross-machine direction has resulted in edge curl.

To illustrate the edge curl problem that can be reduced by the method of the present invention, reference is made to FIGS. 1 and 2. FIG. 1 presents a cross-sectional view of a forming fabric 10 made up of monofilament machine-direction yarns 12 interwoven with monofilament cross-machine direction yarns 14. The long-shute knuckle side 16, often used to form the paper sheet, is characterized by shute knuckles that are broad and flat. This is a consequence of the 1×4 weave pattern in which the cross-machine direction yarn 14 spans four machine-direction yarns 1 for each one it weaves under.

The fact that most of the length of the cross-machine direction yarn 14 lies on the long-shute knuckle side 16 of the machine direction yarn 12 causes the forces acting upon the fabric in the cross-machine direction when shrinkage occurs to be unequal. The rather exaggerated curl shown in FIG. 2 results. The method disclosed here is an attempt to remedy this effect.

Figure 3:
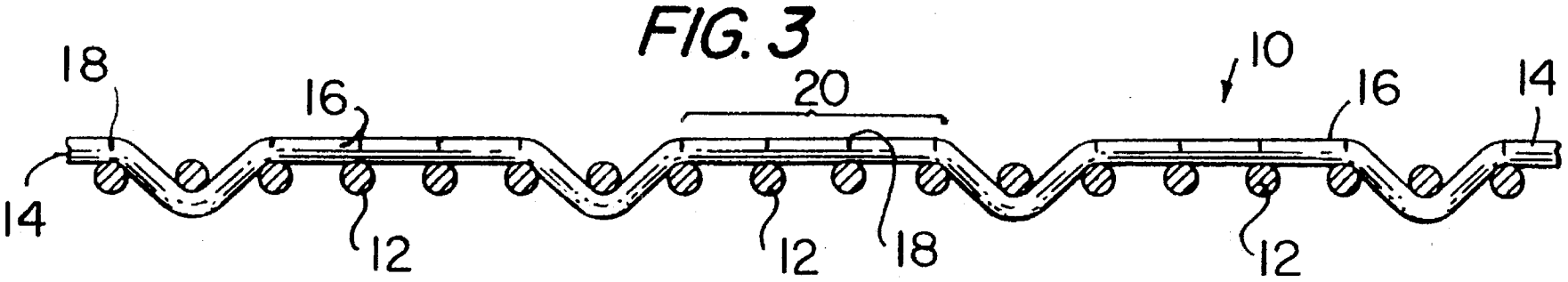
FIG. 3 is also a cross-sectional view similar to that shown in FIG. 1, but it illustrates the slits or scores provided to reduce edge curl in accordance with the present invention.

Referring to FIG. 3, a cross-sectional view similar to that shown in FIG. 1, monofilament cross-machine direction yarns 14 of forming fabric 10 are provided with at least one slit or score 18 per knuckle 20 on the long-shute knuckle side 16. The depth of the slits or scores 18 is preferably no greater than one-half of the diameter of the cross-machine direction yarn 14.

FIG. 4 is a perspective view of a typical endless forming fabric 30. The entire surface of the forming fabric 10 may be provided with slits or scores 18 in accordance with the present invention. However, as an option, only regions lying in a band 22 along each of the two lateral edges of the forming fabric 10 and not extending into the central region 24 could be provided with slits or scores 18. The width of the bands 22 could be chosen to be of a width not extending into the central region 24 of the forming fabric 10 used to form a paper sheet.

The method of the present invention can be practiced as follows. Referring to FIG. 5, the forming fabric 10, either woven in endless form or joined into such a form by seaming, is mounted on a finishing table, which consists of a first roll 26 and a second roll 28, which can be moved apart to place the forming fabric 10 under tension.

A scoring blade 30 is suspended above the forming fabric 10. The scoring blade 30 is then brought into slight contact with the forming fabric and operated to provide at least one slit or score 18 per knuckle 20 to the cross-machine direction yarns 14 on the long-shute knuckle side 16 of the forming fabric 10. This process may be carried out by having the scoring blade 30 move in one direction while the finishing table rollers 26, 28 move the forming fabric 10 in the opposite direction, as indicated by the arrows in FIG. 5.

For example, in an 84-mesh fabric, wherein the cross-machine direction yarns 14 are woven in an "under one and over four" pattern, slits or scores 18 separated transversely by a distance of 1.21 mm would provide the minimum one slit or score 18 per knuckle 20 on the long-shute knuckle side 16. A smaller separation, such as, for example, by one-half or one-fourth that distance, would provide two or four slits or scores 18 per knuckle 20, the latter of which is shown in FIG. 3. In any event, either the entire long-shute knuckle side 16 of the forming fabric 10 or only regions lying in a band 22 along each of the two lateral edges thereof may be so treated in accordance with the present invention.

Although the method provided by the present invention has been described and illustrated for a single-layered forming fabric of specific weave, it should be understood by the reader that it can be applied as well to other kinds of forming fabrics, both single- and multi-layered, having weave patterns such that edge curl may arise in response to unbalanced forces produced across the fabric by the shrinkage of cross-machine direction (CD) yarns. In general, then, one would treat the fabric as disclosed herein on the paper-supporting side of the fabric.

Modifications would be obvious to one skilled in the art without departing from the scope of the invention as defined in the appended claims.

What is claimed is:

1. A method for reducing forming fabric edge curl comprising;

maintaining a forming fabric in a substantially flat condition, said forming fabric being woven from machine-direction and cross-machine direction yarns in a pattern producing a surface on said fabric formed substantially by knuckles of said cross-machine direction yarns, said surface being a long-shute knuckle side of said fabric; and scoring a plurality of said knuckles of said cross-machine direction yarns on said long-shute knuckle side to provide each of said plurality of said knuckles with at least one slit, so that the ratio between the shrink forces acting across the two sides of the forming fabric will approach unity, whereby forming fabric edge curl will be reduced or eliminated.

2. The method as claimed in claim 1 wherein the forming fabric is maintained in a substantially flat condition by placing said forming fabric in endless form around a first roll and a second roll, said first roll and said second roll being a finishing table, and by moving said first roll and said second roll apart so that said forming fabric extends in a substantially flat condition under tension between said first roll and said second roll.

3. The method as claimed in claim 1 wherein said plurality of said knuckles is located in at least one band extending inwardly from an edge of said forming fabric for the length of said forming fabric.

4. The method as claimed in claim 1 wherein said step of scoring is performed using a scoring blade.

5. The method as claimed in claim 2 wherein said step of scoring is performed using a scoring blade, and wherein said first roll and said second roll of said finishing table move said forming fabric beneath said scoring blade.

6. A forming fabric treated in order to reduce or to eliminate edge curl in accordance with the method as claimed in claim 1.

* * * * *